US011523203B1

(12) United States Patent
Ali

(10) Patent No.: US 11,523,203 B1
(45) Date of Patent: Dec. 6, 2022

(54) STARCH BASED EARPHONE COVERS

(71) Applicant: Zeenat Ali, Moreno Valley, CA (US)

(72) Inventor: Zeenat Ali, Moreno Valley, CA (US)

( * ) Notice: Subject to any disclaimer, the term of this patent is extended or adjusted under 35 U.S.C. 154(b) by 0 days.

(21) Appl. No.: 17/198,508

(22) Filed: Mar. 11, 2021

(51) Int. Cl.
*H04R 1/10* (2006.01)

(52) U.S. Cl.
CPC ..... *H04R 1/1016* (2013.01); *H04R 1/1058* (2013.01)

(58) Field of Classification Search
CPC ..... H04R 1/10; H04R 1/1016; H04R 25/65; H04R 25/652; H04R 25/656; H04R 2225/77; H04R 2201/10; Y10T 442/30
See application file for complete search history.

(56) References Cited

U.S. PATENT DOCUMENTS 637,538 A * 11/1899 Van Alstine ..... H04R 1/12 379/452
2,938,967 A * 5/1960 Guardino ..... H04R 1/12 379/452
3,643,040 A * 2/1972 Kaneyasu ..... H04R 1/12 379/452
4,852,163 A * 7/1989 Caceres ..... H04R 1/12 379/451
5,545,859 A * 8/1996 Ullrich ..... H04R 1/12 181/129
5,706,926 A * 1/1998 Secher ..... H04R 1/12 194/247
6,215,871 B1 * 4/2001 Conolly ..... H04R 1/12 379/439
6,218,321 B1 * 4/2001 Lorcks ..... D01F 9/00 442/361
6,292,565 B1 * 9/2001 Chamberlin ..... H04R 1/12 379/439
7,266,196 B1 * 9/2007 Robinson ..... H04R 1/12 134/137
8,111,864 B2 2/2012 Oliveira
8,391,533 B2 3/2013 Sim
10,448,145 B1 * 10/2019 Lewis ..... H04R 1/12
2003/0012371 A1 * 1/2003 Weinstock ..... H04R 1/12 379/452
2003/0081806 A1 * 5/2003 Young ..... H04R 1/12 381/370

(Continued)

FOREIGN PATENT DOCUMENTS

BR 102019026098 A2 * 6/2021
CN 101283034 A * 10/2008 ..... A61L 15/28

(Continued)

*Primary Examiner* — Ryan Robinson
(74) *Attorney, Agent, or Firm* — Sanchelima & Associates, P.A.; Christian Sanchelima; Jesus Sanchelima

(57) ABSTRACT

A fiber-based cover for an earphone wherein the cover is made of starch fibers which enhance the sound waves to increase the volume of the sound coining from the earphones without causing damage to the ear drums. The cover includes a body having a substantially frusto-conical shape. Additionally, the cover includes a front end and a rear end. In the present embodiment, the rear end is an open end with a cylindrical shape that receives an earbud therein. The front end is a closed end defined with a front surface. The front surface comprises of starch-based fibers formed into a circular shape. The starch properties uniquely filter out sound frequencies to enhance a user's listening experience.

11 Claims, 3 Drawing Sheets

(56) References Cited

U.S. PATENT DOCUMENTS

| | | | | |
|---|---|---|---|---|
| 2003/0086563 | A1* | 5/2003 | Lashley | H04R 1/12 379/452 |
| 2003/0147528 | A1* | 8/2003 | Pfaff | H04M 1/17 379/451 |
| 2007/0036383 | A1* | 2/2007 | Romero | H04R 1/1016 381/370 |
| 2016/0261945 | A1* | 9/2016 | Kurtz | H04R 1/1058 |
| 2016/0302001 | A1* | 10/2016 | Cordes | H04R 1/12 |
| 2018/0376236 | A1* | 12/2018 | Prevoir | H04R 1/1066 |
| 2021/0099785 | A1* | 4/2021 | Abernathy | H04R 1/1058 |

FOREIGN PATENT DOCUMENTS

| | | | | |
|---|---|---|---|---|
| EP | 0855847 | A2 * | 7/1998 | |
| FR | 3074630 | A1 * | 6/2019 | |
| GB | 1330757 | A * | 4/1971 | H04R 1/12 |
| KR | 200204510 | Y1 * | 11/2000 | H04R 1/1058 |

* cited by examiner

STARCH BASED EARPHONE COVERS

BACKGROUND OF THE INVENTION

1. Field of the Invention

The present invention relates to starch-based earphone covers and, more particularly, to a fiber-based cover for an earphone that filters sound waves and allows a user to easily clean and replace the covers for continuous sanitary use.

2. Description of the Related Art

Several designs for earphone covers have been designed in the past. None of them, however, include a fiber-based cover for an earphone wherein the cover is composed of starch fibers which enhance the sound waves to increase the volume of the sound coining from the earphones without causing damage to the ear drums. The cover includes a body having a substantially frusto-conical shape. Additionally, the cover includes a front end and a rear end. In the present embodiment, the rear end is an open end with a cylindrical shape that receives an earbud therein. The front end is a closed end defined with a front surface. The front surface comprises of starch-based fibers formed into a circular shape. The starch properties uniquely filter out sound frequencies to enhance a user's listening experience. It is known that earbuds which are inserted into a user's ear is often dirtied with earwax after continuous use. This waste causes unsanitary build up on the earbud and undesirably filters the sound going into the ear.

Applicant believes that a related reference corresponds to U.S. Pat. No. 8,111,864 issued for a sound enhancing cover for an earphone. Applicant believes that another related reference corresponds to U.S. Pat. No. 8,391,533 issued for a cushioned cover for an earphone. However, the cited references differ from the present invention because they fail to disclose a fiber-based cover for an earphone wherein the cover is composed of starch fibers which enhance the sound waves to increase the volume of the sound coining from the earphones without causing damage to the ear drums.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide starch based earphone covers that enhances the quality of the sound that is output from earbuds by taking advantage of the sound filtering properties of starch material.

It is another object of this invention to provide starch based earphone covers that aids a user in maintaining sanitary audio equipment to prevent ear infections.

It is still another object of the present invention to provide a starch based earphone covers which may be easily replaceable and reused on various designs of earbuds.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
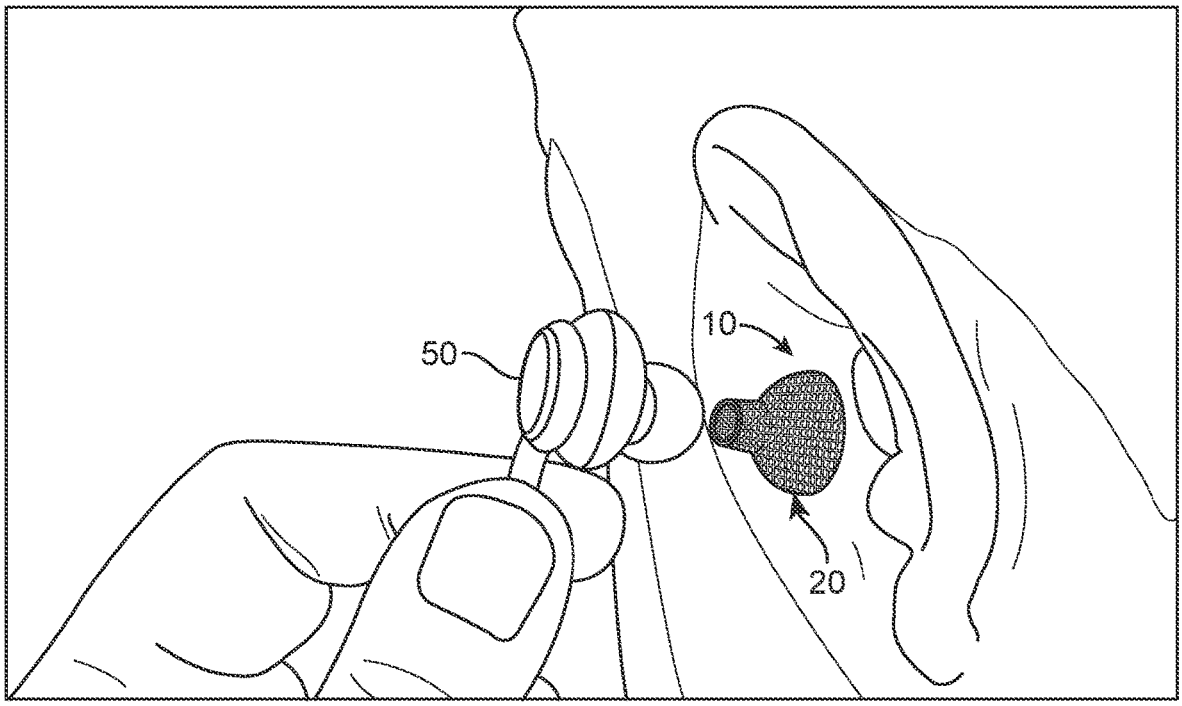
FIG. 1 represents an operational isometric view of starch based earphone covers 10 in accordance with an embodiment of the present invention.

Referring now to the drawings, where the present invention is generally referred to with numeral 10, it can be observed a starch based earphone cover system 10 which basically includes a cover assembly 20 and a base assembly 40.

Figure 2:
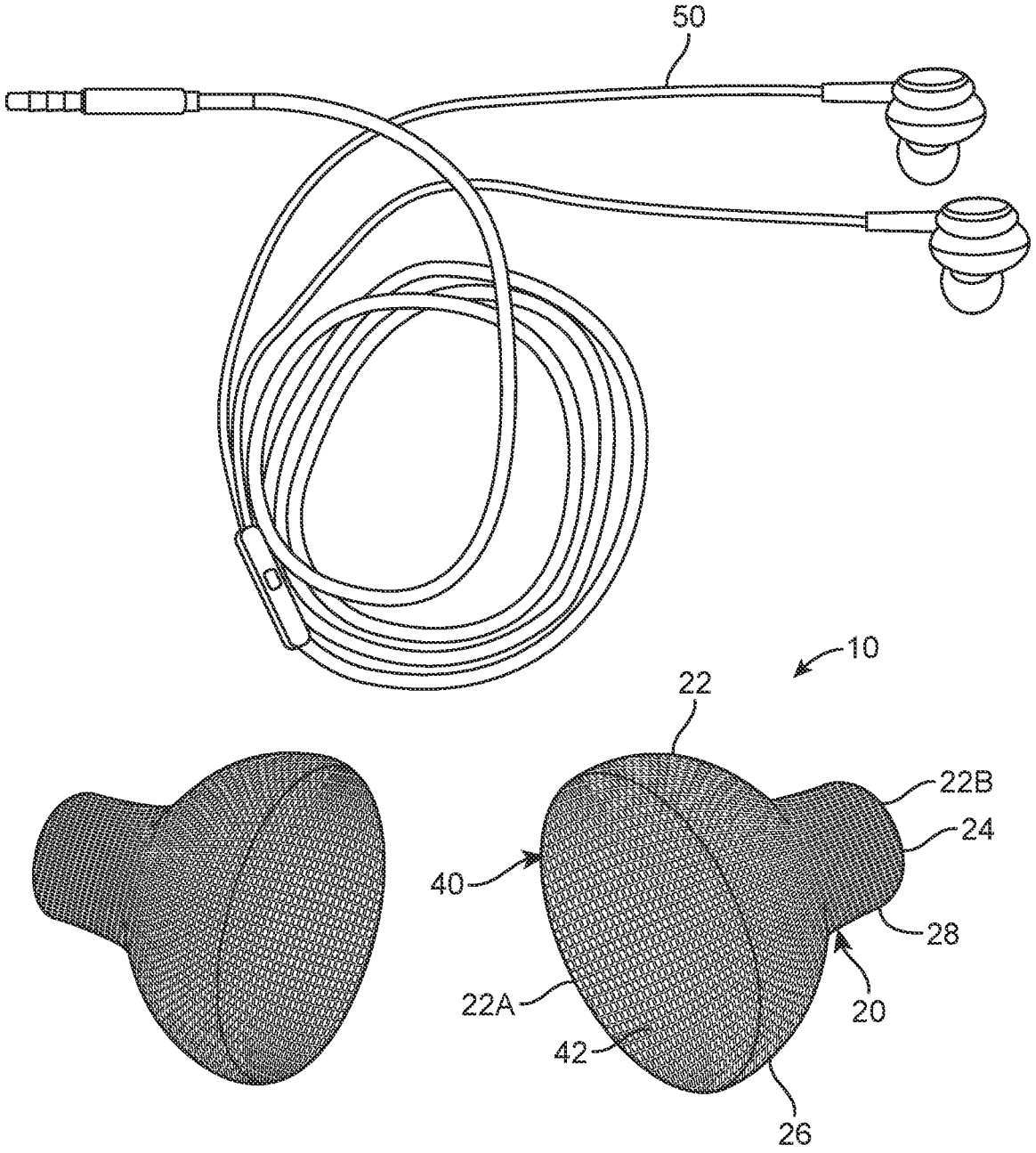
FIG. 2 shows an isometric view of starch based earphone covers 10 depicting a cover assembly 20 and a base assembly 40 in accordance with an embodiment of the present invention.
Figure 3:
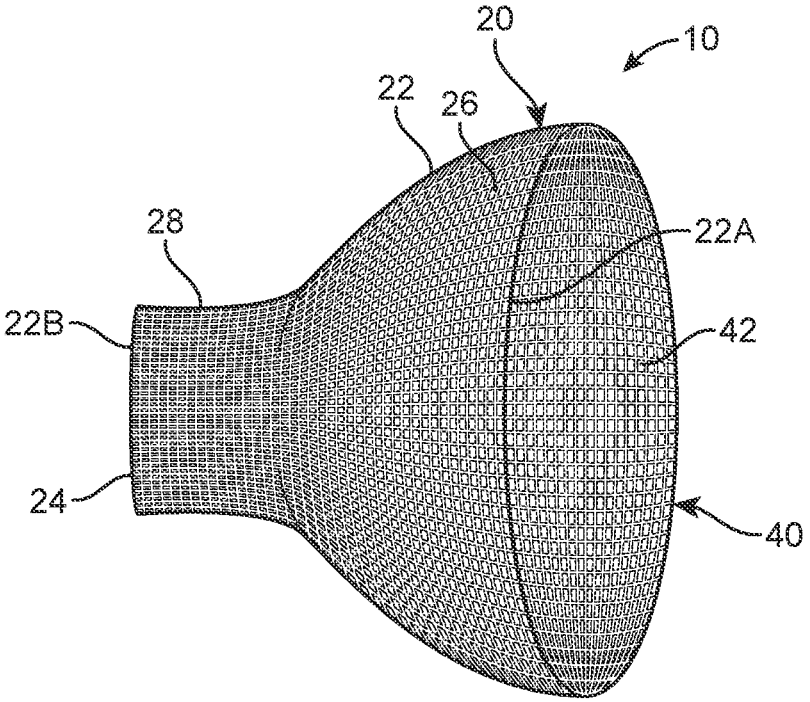
FIG. 3 illustrates a side view of starch based earphone covers 10 in accordance with an embodiment of the present invention.
Figure 4:
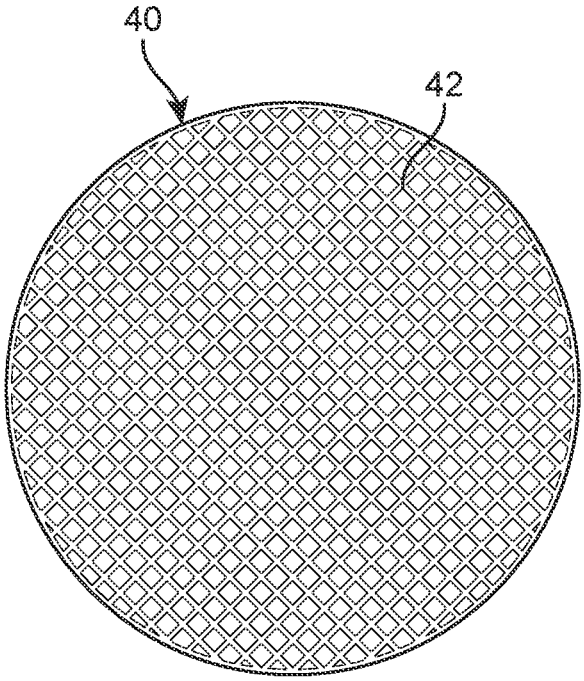
FIG. 4 is a representation of a front view of starch based earphone covers 10 in accordance with an embodiment of the present invention.

Cover assembly 20 includes a body 22 which can be observed in FIG. 2 of the provided drawings. In one embodiment, body 22 is made of a stretchable elastic material. This may include elastomers with high elastic nature that include natural rubber, synthetic rubber, nitrile rubber, silicone rubber, urethan rubbers, chloroprene rubber, Ethylene Vinyl Acetate and the like. Furthermore, body 22 may have a substantially frusto-conical shape. As a result, front end 22A and rear end 22B is provided as flat body ends. In the present embodiment, front end 22A comprises of a circular shape and includes base assembly 40 mounted thereon. Further, rear end 22A may also comprise of a circular shape. However, rear end 22A is an open back end with opening 24 providing access to the interior of body 22. In the present embodiment, front end 22A has a diameter that is greater than the diameter of rear end 22B.

Cover assembly 20 further includes a bulbous portion 26 and a neck portion 28. In the present embodiment, bulbous portion 26 is the portion of body 22 located towards front end 22A. Neck portion 28 is the portion of body 22 located towards rear end 22B. In one implementation, neck portion 28 is a substantially cylindrical portion with a diameter corresponding to the diameter of rear end 22B. Furthermore, bulbous portion 28 is a dome shaped portion with varying diameter along its structure. In the present embodiment, neck portion 28 is stretched open in order to then fit an earbud of earphones 50 therein. The earbud is then inserted within body 22 until in comfortably rests within bulbous portion 26. Once inserted, the pull tension of neck portion 28 is then released to effectively lock the neck portion 28 onto the earbud. It should be understood that the present system provides two of cover assembly 20 corresponding to the two earbuds that are provided for earphone 50. However, the system may utilize only one of cover assembly 20 and using two is not required for the system to function effectively.

Base assembly 40 includes a starch base 42 which is embedded within front end 22A. In the present embodiment, starch base 42 is a circular base having a diameter corresponding to the diameter of front end 22A. Additionally, starch base 42 is comprised of starch fibers. Starch fibers contain different sound absorption properties which can be utilized as a sound filter when placed over an audio source such as an earbud. When placed in a user's ear, the starch base 42 uniquely filters the sounds waves produced from the earbud and enhances the listening experience for the user. In one particular embodiment, starch base 42 consists exclusively of starch fibers which are woven into warp and weft thread formations. In this embodiment, warp starch fibers are held stationary in tension on a frame while transverse weft starch fibers are drawn and inserted through and inserted over-and under the warp. Other embodiments may feature combinations with other variations of fibers. Other embodiments may also feature different knots and weaves such as the Ghiordes knot, Senneh knot, and a satin weave.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A starch based earphone cover system, comprising:

a. a cover assembly including a body having a front end and a rear end related by a bulbous portion with a dome body and a neck portion, wherein said body has a substantially frusto-conical shape with said bulbous portion and said neck portion concentrically placed on each end of said body and separated by a predetermined distance between each other, wherein said rear end includes an opening concentrically placed with said front end, wherein said front end and said rear end are concentrically placed and circular in shape; and b. a base assembly including a starch base comprising of starch fibers embedded into the body into an inner circular structure, wherein said starch base is mounted onto said front end of said body such that the starch base entirely covers the front end and remains concentrically relative to said opening of said rear portion.

2. The starch based earphone cover system of claim 1 wherein said body is made of an elastic material keeping a frusto-conical shape after being removed from an earphone.

3. The starch based earphone cover system of claim 2 wherein said elastic material is an elastomer with a high elastic nature selected from a group consisting essentially of natural rubber, synthetic rubber, nitrile rubber, silicone rubber, urethan rubbers, chloroprene rubber, Ethylene Vinyl Acetate that is delimited by said starch base.

4. The starch based earphone cover system of claim 1 wherein said body includes said neck portion being concentrical to said starch base.

5. The starch based earphone cover system of claim 1 wherein said body includes said bulbous portion having a dome shape that clamps a perimeter of said starch base.

6. The starch based earphone cover system of claim 1 wherein said front end has a diameter which is greater than a diameter of the rear end both being concentrically and parallelly placed with a predetermined distance between each other configured to store said earphone within said front end.

7. The starch based earphone cover system of claim 1 wherein said starch fibers are formed into a warp and weft thread formation entirely covering said starch base delimited by its circular perimeter configured to enhance the sound waves to increase the volume of the sound coming from the earphones.

8. The starch based earphone cover system of claim 5 wherein said body is mounted onto an earbud of a pair of earphones until faces said starch base which is configured to be attached within an user's ear.

9. The starch based earphone cover system of claim 8 wherein said earbud rests within bulbous portion when said earbud is inserted within the body allowing an earbud speaker to match said starch base.

10. A starch based earphone cover system, comprising:

a. a cover assembly including a body having a front end and a rear end related by a bulbous portion with a dome body and a neck portion, wherein said body has a substantially frusto-conical shape with said bulbous portion and said neck portion concentrically placed on each end of said body and separated by a predetermined distance between each other, wherein said rear end includes an opening, wherein said front end and said rear end are concentrically placed and circular in shape, said front end having a diameter greater than a diameter of said rear end both being concentrically and parallelly placed with a predetermined distance between each other configured to store said earphone within said front end, wherein said body is made of an elastic material that is delimited by said starch base, said body further including a neck portion located towards said rear end and a bulbous portion located towards said front end wherein each perimeter of said neck portion and said bulbous portion are concentrically placed; and b. a base assembly including a starch base consisting of starch fibers formed into a circular structure which are embedded into the front end of the body delimited by a circular perimeter, wherein said starch base is mounted onto said front end of said body such that the starch base entirely covers the front end having its perimeter concentrically placed with said opening, wherein said starch fibers are formed into a warp and weft thread formation, said body is mounted onto an earbud of said pair of earphones, wherein said earbud rests within bulbous portion when said earbud is inserted within the body comprising an horizontal inserting configuration.

11. A starch based earphone cover system, consisting of:

a. a cover assembly including a body having a front end and a rear end related by a bulbous portion with a dome body and a neck portion, wherein said body has a substantially frusto-conical shape with said bulbous portion and said neck portion concentrically placed on each end of said body and separated by a predetermined distance between each other, wherein said rear end includes an opening concentrically placed with said front end, wherein said front end and said rear end are concentrically placed and circular in shape, said front end having a diameter greater than a diameter of said rear end both being concentrically and parallelly placed with a predetermined distance between each other configured to store said earphone within said front end, wherein said body is made of an elastic material that is delimited by said starch base, wherein said elastic material is an elastomer with a high elastic nature selected from a group consisting essentially of natural rubber, synthetic rubber, nitrile rubber, silicone rubber, urethan rubbers, chloroprene rubber, Ethylene Vinyl Acetate that is delimited by a circular perimeter of said starch base, said body further including a neck portion located towards said rear end and a bulbous portion located towards said front end wherein each perimeter of said neck portion and said bulbous portion are concentrically placed; and b. a base assembly including a starch base consisting of starch fibers formed into a circular structure delimited by a circular perimeter, wherein said starch base is mounted onto said front end of said body such that the starch base entirely covers the front end also delimited by the body made by said elastic material, wherein said starch fibers are formed into a warp and weft thread formation entirely covering said starch base delimited by its circular perimeter configured to enhance the sound waves to increase the volume of the sound coming from the earphones, said body is mounted onto an earbud of a pair of earphones, wherein said earbud rests within bulbous portion when said earbud is inserted within the body.

* * * * *